United States Patent [19]

Houlbrook et al.

[11] Patent Number: 4,619,382

[45] Date of Patent: Oct. 28, 1986

[54] DISPENSERS FOR FLOWABLE COMPOSITIONS

[75] Inventors: Kenneth Houlbrook, Huddersfield; Paul A. Thornton, Barnsley, both of England

[73] Assignee: Clantex Limited, W. York, England

[21] Appl. No.: 685,231

[22] Filed: Dec. 21, 1984

Related U.S. Application Data

[62] Division of Ser. No. 574,046, Jan. 26, 1984, Pat. No. 4,508,245.

[30] Foreign Application Priority Data

Feb. 24, 1981 [GB] United Kingdom ..... 8105793

[51] Int. Cl.[4] ..... B65D 88/54

[52] U.S. Cl. ..... 222/327; 222/567

[58] Field of Search ..... 222/290, 256, 326, 327, 222/325, 544, 566, 567, 569; 401/48, 193; 118/708, 710, 305

[56] References Cited

U.S. PATENT DOCUMENTS

| | | | |
|---|---|---|---|
| 2,546,194 | 3/1951 | Livadas | 222/567 |
| 2,552,154 | 5/1951 | Danielson | 222/566 |
| 3,931,915 | 1/1976 | Downings et al. | 222/327 |
| 4,182,264 | 1/1980 | Gibson et al. | 401/48 |

*Primary Examiner*—Joseph J. Rolla
*Assistant Examiner*—Kenneth Noland
*Attorney, Agent, or Firm*—Fred Philpitt

[57] ABSTRACT

The invention provides a cartridge for use in dispensing a crease setting composition into a temporary crease of a garment in order to make that crease permanent. The cartridge is connected to a mechanism which by movement of the cartridge and mechanism relative to the crease causes the dispensing of the composition from a nozzle at the end of the cartridge. The end of the cartridge is of reinforced construction in order to support the nozzle in a firm and effective manner. The nozzle is normally in the form of a tube which fits in a bore in end and the bore intersects the end of a cavity inside the cartridge which is conical in shape so as to give a small area of intersection.

8 Claims, 6 Drawing Figures

DISPENSERS FOR FLOWABLE COMPOSITIONS

This is a division of application Ser. No. 574,046, filed Jan. 26, 1984 now U.S. Pat. No. 4,508,245 and the benefits of 35 USC 120 are claimed relative to it.

The present invention relates to dispensers for flowable compositions, and more especially, to disposable cartridges or containers for such compositions adapted for use with apparatus for controlled dispensing thereof.

In U.S. Pat. No. 4,182,264 there is disclosed an applicator for depositing a crease-setting composition on the line of an intended crease in a textile fabric or garment, the applicator comprising a reservoir for such composition, or means for attachment of such a reservoir, a nozzle connected or connectable to the reservoir, a rotatable member arranged so as to be engageable with the fabric or garment surface on both sides of the crease line and rotatable by relative movement between the surface and the applicator, and a mechanism responsive to rotation of the member to urge the composition from the reservoir through the nozzle.

As mentioned in that specification, the crease-setting composition may be supplied in a replaceable and disposable container or cartridge, for fitting to an apparatus comprising the rotatable member and the means responsive to its rotation to expel the composition from the cartridge.

Of the specific design of cartridge which has been used up to the present time, this comprises a tubular body closed at one end by an integral conical end wall of the same thickness as the tubular body, the other end being for connection to the applicator mechanism. The conical wall is intersected by a through bore lying at right angles to the axis of the tubular portion, and when the cartridge is supplied (filled) the apertures in the conical wall are is closed by a removable pin. To make the cartridge ready for use, the pin is removed, exposing the composition at said apertures, and then a nozzle tube is inserted in the bore. The nozzle tube has a nozzle at one end, is closed at the other end and has an inlet in the wall through which the composition can pass on its way to the nozzle outlet. The composition in fact contacts the nozzle tube around the periphery thereof between the apertures in the conical wall.

This design has shown itself to have a number of shortcomings and in practice has attracted much critisism. Thus, because of the small contact area between the conical wall and nozzle tube, with repeated insertion and removal of the nozzle tube (which is necessary because the composition in the nozzle tube has a tendency to set when the apparatus stands idle), wear of the conical wall at said apertures takes place and leakage of composition occurs when the apparatus is in use. Conversely, when the apparatus is idle, contact of the composition at said apertures with the atmosphere causes undesirable hardening of the composition. Also, the repeated removal and replacement of nozzle tubes is wasteful of the composition as some composition is inevitably extruded from the aperture which is remote from the aperture through which the nozzle tube is first inserted at each insertion of the nozzle tube. Also, the repeated changing of nozzle tubes means repeated exposure of a relatively large surface area of composition in the body to the atmosphere. Furthermore, the forming of the bore in the conical portion has the effect of considerably weakening the cartridge at that end.

The present invention seeks to provide a cartridge body and a cartridge for use mainly in processes of a nature outlined in the said U.S. Patent, but which does not suffer from, or suffers less from, the disadvantages of the cartridge which is currently in use.

It should be mentioned however, that the applicator cartridge can be constructed and arranged for any suitable process requiring the dispensing of fluent composition.

According to a first aspect of the invention, a cartridge body comprises an elongated portion, having a hollow interior for receiving the composition to be dispensed from the cartridge, the hollow interior being closed at one end by a nozzle end portion which has a bore for receiving a nozzle tube, the bore extending transversely of the elongated portion and intersecting the interior at the single zone of intersection which in the direction transverse to the axis of the bore is of less dimension than the width of the bore.

According to a second aspect of the invention, a cartridge body comprises an elongated portion having a hollow interior for receiving the composition to be dispensed from the cartridge, the hollow interior being closed by a nozzle end portion which is a reinforced construction as compared to the elongated portion, said nozzle end portion having a bore communicating with the hollow interior thereof of the elongated body, said bore being adapated to receive or co-operate with a nozzle tip or nozzle tube for the dispensing of the composition.

According to a third aspect of the invention, a cartridge body comprises an elongated portion having a hollow interior for receiving the composition to be dispensed from the cartridge, the hollow interior being closed at one end by a nozzle end portion which has a bore for receiving or co-operating with a nozzle tube or tip, the bore extending transversely of the elongated portion and intersecting the interior, the said intersection of the bore and interior being sealed by a rod or pin which is of a material which is less rigid than that of the nozzle end portion and which is removably friction fitted in said bore.

Preferably, the bore has a portion of non-circular section for engagement with a portion of a nozzle tube of similar section, to facilitate positioning of the nozzle tube when inserted in said bore.

Preferably also, the said interior is at least largely of constant cross section for slidably receiving a piston by which the composition can be dispensed from the cartridge, for example, as described in said U.S. patent.

The invention also provides a cartridge including a cartridge body as aforesaid with removable means sealing the bore, and a quantity of composition in the said interior.

Although the bore may be formed in any convenient way, for example by drilling, it is particularly advantageous for it to be formed by moulding.

The various aspects of the invention will be further described, by way of example, with reference to the accompanying drawings, in which.

Figure 4:
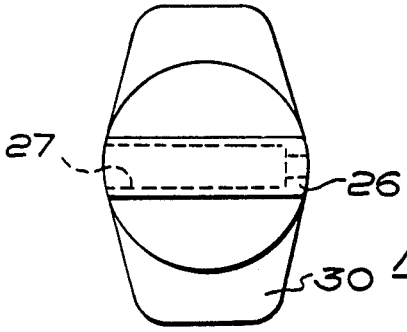

FIG. 4 an end elevation of the same cartridge.

Figure 1:
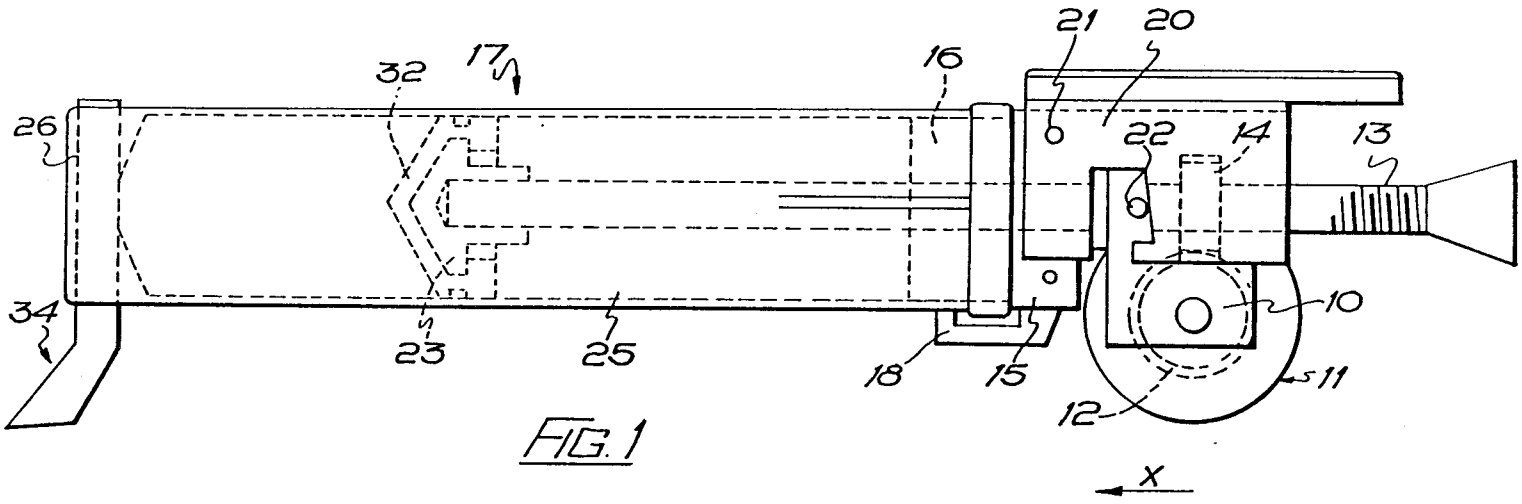
FIG. 1 is a side view of an applicator for crease-setting compositions incorporating a cartridge according to this invention.

The complete applicator shown in FIG. 1 comprises a body 10 in which is rotatably mounted a doubly flanged roller 11 which incorporates a worm gear 12. A threaded rod 13 passes slidably through the body 10 and carries an internally threaded and externally toothed annular pinion 14, the external teeth of which mesh with worm gear 12, and the internal teeth of which engage the threaded rod 13. A mounting block 15 surrounding the rod 13 and adjacent to the body 10 has a cylindrical portion 16 over which a cartridge 17 containing the composition to be dispensing is removably fitted. The cartridge 17 is locked by a pivoted locking member 18. A rocking link 20 is pivoted on the block 15 at 21 and has a surface 20A acting against a pin 22 on the body so that rocking of the link causes the body to be brought into greater proximity with the block 15 in the direction of arrow X against the action of an internal spring (not shown).

The end of the rod 13 which projects beyond the block 15 carries a piston body 23. This mechanism is amply described in the aforementioned U.S. Patent and reference is made thereto for specific details.

Figure 2:
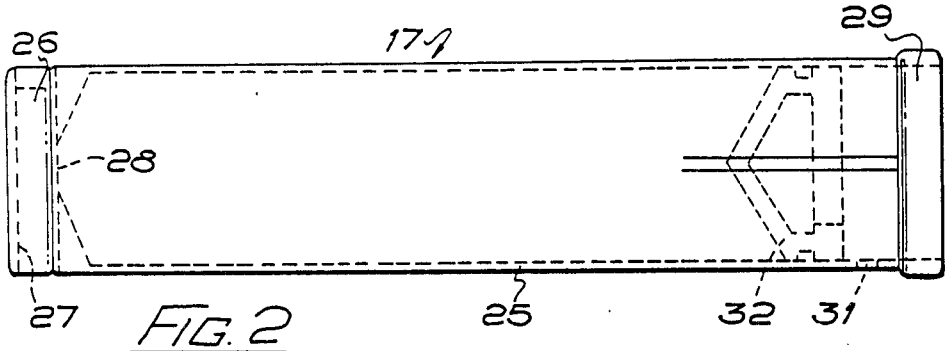
FIG. 2 is a more detailed side elevation of the cartridge of FIG. 1, FIGS. 2A and B showing the dispensing end of the cartridge fitted respectively with a sealing bung and (in section) a dispensing nozzle.
Figure 3:
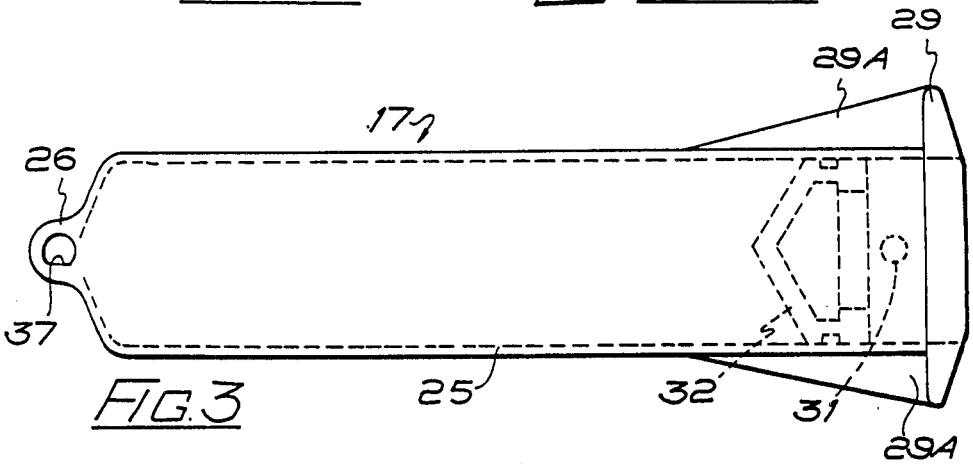
FIG. 3 is a top plan view of the cartridge of FIG. 2.

The cartridge 17 as better seen in FIGS. 2 to 4, comprises a body including a hollow cylindrical portion 25, which is open at one end but is provided the other end with a nozzle end portion in the form of a transverse dispensing housing 26 which is rigid plastics and is much thicker than the cylindrical portion 25 and is also formed with a bore 27 extending perpendicular to the longitudinal axis of the portion 25 intersecting the interior of the body at an opening 28. The opening 28 is of circular shape and the interior of the portion 25 is conical at the nozzle end, and the bore is made to intersect the apex of the cone so that the diameter of the aperture 28 is less than the diameter of the bore 26. The body is preferably moulded integrally with the housing (which is solid plastics material) from a suitable synthetic resin, such as polypropylene. An integrally moulded flange 29 with fins 29A at the open end of the body strengthens the end and provides convenient purcahse when fitting the cartridge to and removing it from the applicator mechanism. A hole 31 is provided to receive the locking member 18 to retain the cartridge in position.

Figure 2A:
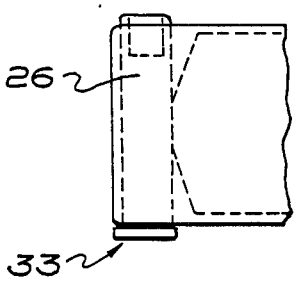

A piston seal 32 of general conical form is a slidable but tight fit inside the body 17 and serves as a closure for the open end of the body to retain the contents of the body out of contact with the air. It is shaped to cooperate with the piston body 23 when the latter is inserted into the cartridge as the cartridge is fitted to the dispenser mechanism, and then serves to expel composition from the body as the piston is driven along the body by the applicator mechanism, in the manner as described in the said U.S. Patent. The dispensing end of the cartridge is sealed during storage by a closure plug or peg 33 (FIG. 2A) which is a tight fit in the bore 27 and thus closes off the opening 28. The peg is in fact made of a somewhat less rigid material than the body 23, for example being moulded from plasticized polyvinyl chloride, and therefore the plug 33 bulges into the opening 28 and thus will form an excellent seal at the opening 28.

Figure 2B:
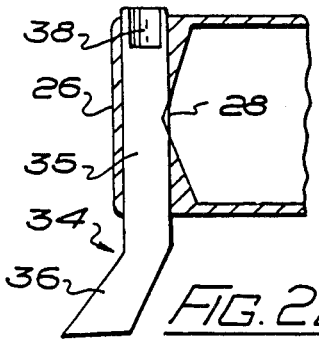

When the applicator is to be used, the cartridge 17 is fitted on the block 15 and locked in position by the member 18. The piston is then advanced down the body 23 by rotation of the threaded rod 13 until it engages and then seats firmly in the seal 32. The peg 33 is then removed from the bore and replaced by a nozzle 34 or a nozzle tip which simply plugs into the end of bore 26 as shown in FIG. 2B. This consists of a rigid tube 35, for example of stainless steel, closed at its upper end but at its lower end formed with a broadened delivery portion 36 terminating in a straight, narrow slot. An opening in the side wall of the tube 35 is provided at a position where it will register with the opening 28 into the body 25. The applicator is then ready for use, but a desirable degree of pressure on the contents of the cartridge can be applied by actuating the rocking link 20.

The mode of use of the applicator on an actual garment is fully described in the U.S. patent referred to. However, a brief indication may be given here. The applicator as a whole is drawn along a performed crease in a suitably supported garment, with the flanged roller in contact with the garment on either side of the crease. This causes rotation of the roller, whereby the piston and seal are advanced along the cartridge to expel a controlled quantity of setting composition into the apex of the crease. The crease may be set simply by letting the composition cure or by pressing the garment.

It has been found that the most uniform application of crease-setting composition, and thus the formation of the most satisfactory permanent creases, is achieved when the nozzle slot is accurately positioned in a longitudinal direction. The invention enables this requirement to be met, by forming the upper part of the bore 27 with a reduced section having a flat face 37. A corresponding flat face 38 at the upper part of the tube 35 ensures accurate orientation of the nozzle slot, while the relatively massive rigid housing 26 surrounding the tube ensures that there is no significant variation in the inclination of the nozzle slot. A peg 33 to be used with a bore housing a flat face 37 should itself have a corresponding flat face at its upper end.

It is desireable that the outlet nozzle slot should be at an angle, of about 5 degrees to the general plane of the garment in the vicinity of the crease.

The cartridge body described has a number of significant advantages. Thus, because the housing is of thickened rigid plastics, there is relatively little opportunity for the nozzle tube to tilt in use. Also, there is relatively little contact between the outside of the nozzle tube and the composition in the cartridge, i.e. only the area of hole 28, and therefore there is relatively little opportunity for leakage to take place. The leakage prevention is further enhanced by the use of a sealing plug of a material which is less rigid than that of the nozzle end portion so that the sealing plug will bulge into the said opening 28. Accurate positioning of the nozzle tube is achieved by the use of non-circular bore portion 27.

Although reference has been made herein to the cartridge body as having an elongated portion. The expression elongated is used to facilitate understanding of the preferred embodiment, but it is recognised that the cartridge body need not in fact be elongated in the strict geometrical meaning of the word.

We claim:

1. A cartridge apparatus for the application of viscous crease-setting composition to creases of garments comprising (a) an elongated and disposable cartridge body for containing a quantity of the crease-setting composition;

(b) a cartridge body outlet at one end of the body, (c) means adapting the cartridge body to be connected at the other end to a dispensing mechanism to enable the composition to be discharged from said body outlet, (d) a nozzle tube supporting body at said one end of the cartridge body, (e) a bore in the nozzle tube supporting body communicationg with said outlet and lying transverse to the cartridge body;

(f) a rigid hollow nozzle tube sealingly push-fitted in the supporting body bore with an end projecting therefrom;

(g) an inlet in the wall of the nozzle tube communicating with said outlet so that composition discharged therethrough passes into the entrance of the nozzle tube through the tube wall;

(h) a nozzle outlet slot at an end of the nozzle tube projecting from the body, said nozzle outlet slot receiving composition from the rotation of the nozzle tube and being an elongated narrow slot extending in the direction of the cartridge body; and (i) means preventing any turning of the nozzle tube relative to the supporting body which could block communication between said outlet and said outlet on the wall of the nozzle and could alter the angle of the nozzle slot relative to the cartridge body.

2. A cartridge apparatus according to claim 1 wherein the cartridge body and the nozzle tube supporting body are made of plastics material and are integral.

3. A cartridge apparatus according to claim 1 wherein the said bore extends entirely through the cartridge body.

4. A cartridge apparatus according to claim 1 wherein said bore at the opposite end from which the nozzle tube is inserted has a flat shape and the end of the nozzle has a similar flat shape which engages with the bore flat shape to ensure that the nozzle tube will be prevented from rotating in the bore and automatically will take up the correct angular disposition in the bore when inserted.

5. A cartridge apparatus according to claim 1 wherein said cartridge outlet is formed by an internal conical surface at the end of the cartridge body intersecting the said bore in the central region thereof.

6. A cartridge apparatus according to claim 1 wherein the nozzle tube is frictionally fitted in the said bore.

7. A cartridge apparatus according to claim 1 including a piston slidably located in the cartridge body by which composition is forced therefrom.

8. A cartridge apparatus according to claim 1 characterized by a quantity of resin in the cartridge body.

* * * * *